US008272400B2

(12) United States Patent
Zhang

(10) Patent No.: US 8,272,400 B2
(45) Date of Patent: Sep. 25, 2012

(54) GAS VALVE CONTROL DEVICE

(75) Inventor: Feng Zhang, Ningbo (CN)

(73) Assignee: Ningbo Wanan Co., Ltd., Ningbo (CN)

( * ) Notice: Subject to any disclaimer, the term of this patent is extended or adjusted under 35 U.S.C. 154(b) by 557 days.

(21) Appl. No.: 12/495,832

(22) Filed: Jul. 1, 2009

(65) Prior Publication Data

US 2011/0001069 A1 Jan. 6, 2011

(51) Int. Cl.
*F16K 31/02* (2006.01)

(52) U.S. Cl. ..... 137/624.11; 251/129.03

(58) Field of Classification Search ..... 137/65, 137/66, 624.11; 251/129.01, 129.03; 431/53, 431/54

See application file for complete search history.

(56) References Cited

U.S. PATENT DOCUMENTS 4,242,080 A * 12/1980 Tabei ..... 431/54
6,769,447 B2 * 8/2004 James ..... 137/66
7,252,109 B2 * 8/2007 Colombo ..... 137/66

FOREIGN PATENT DOCUMENTS

CN 2608857 Y 3/2004
CN 2783056 Y 5/2006

* cited by examiner

*Primary Examiner* — Kevin Lee
(74) *Attorney, Agent, or Firm* — Matthias Scholl P.C.; Matthias Scholl

(57) ABSTRACT

A gas valve control device, including at least: a timing controller, and a valve, including at least a rotating button, a contact plate, an electromagnetic valve, a pressing spring, a valve cover, a valve pole, a fixing pin, a plug bar, and a valve body having a cavity. Advantages of the gas valve control device include: integration of a timing controller and a control valve; timing control can be implemented mechanically or electrically; compact structure and good appearance; easy operation; safe and reliable; and accurate timing.

13 Claims, 9 Drawing Sheets

GAS VALVE CONTROL DEVICE

BACKGROUND OF THE INVENTION

1. Field of the Invention

The invention relates to a gas valve control device.

2. Description of the Related Art

Conventionally, a pressure regulating valve of a gas stove is used to turn on or off gas source, and there is no gas source control device between the gas stove and the pressure regulating valve. As a result, if a user forgets to turn off the gas, accidents such as suffocation, fire or explosion may take place.

To overcome the above-mentioned problems, China Patent Application No. 200420102387.3 discloses a home-use gas control valve consisting of a valve having a valve pole, a housing connected to the valve, a timer disposed in the housing, a dial disposed at the top of the housing, and a hand wheel. A lower end of an axis of the timer is connected to the valve pole, and hand wheel is fit to an upper end of the axis of the timer. However, the home-use gas control valve has severe problems, such as a large timing error and deadlocking, and therefore gas cannot be accurately turned off.

China Patent Application No. 02206546.6 discloses a time control gas stove and a timing valve therefore. The timing valve consists of an electronic timing switch, a thermoelectric couple, an electromagnetic valve and a wire, and the electronic timing switch is serially connected to the thermoelectric couple and the electromagnetic valve. In operation, when a time preset by the electronic timing switch is up, the electromagnetic valve turns off the gas and the stove and thus time control is facilitated. However, the timing valve has single structure, rough appearance, and short life.

SUMMARY OF THE INVENTION

In view of the above-described problems, it is an objective of the invention to provide a gas valve control device that is capable of accurately turning off gas electrically or mechanically, features compact structure, long life and esthetic appearance, and integrates functions of a control valve and a timing controller.

To achieve the above objective, in accordance with one aspect of the invention, there is provided a gas valve control device, comprising: a timing controller, and a valve, comprising a rotating button, a contact plate, an electromagnetic valve, a pressing spring, a valve cover, a valve pole, a fixing pin, a plug bar, and a valve body having a cavity. The upper portion of the valve body is connected to the valve pole. The upper portion of the valve pole protrudes from the valve body. The lower portion of the valve pole is received in the cavity of the valve body whereby enabling the valve pole to move upwards and downwards therein. The plug bar and the pressing spring are disposed at the bottom of the valve pole. The pressing spring is disposed outside the plug bar. The rotating button is disposed at the top of the valve pole. The contact plate is disposed below the rotating button and is connected to the top of the valve pole. The fixing pin is disposed on the valve pole. The valve pole is capable of sliding in a groove in the valve cover via the fixing pin. The rotating button is capable of rotating left and right and moving upwards and downwards in the groove. And, the timing controller is fixedly connected to the valve and to the electromagnetic valve.

In certain classes of this embodiment, the valve body comprises an inlet port, an outlet port and a vent line; the inlet port and the outlet port are disposed on the valve body; the vent line is disposed between the inlet port and the outlet port; and the vent line is controlled by the timing controller.

In certain classes of this embodiment, an inlet port joint is connected to the inlet port; and a sleeve ring is connected to the outlet port.

In certain classes of this embodiment, an electromagnetic valve lead is disposed on one end of the electromagnetic valve; the electromagnetic valve is connected to the timing controller via the electromagnetic valve lead; a valve sheet is disposed on the other end of the electromagnetic valve and operates to control the vent line; and a sealing gasket and an ejecting block are disposed on the valve sheet.

In certain classes of this embodiment, the timing controller comprises an electronic circuit board, an upper shell, and a lower shell; a first contact head, a second contact head, and a third contact head are disposed on the upper shell and are connected to the electronic circuit board via a contact head wire; and the electronic circuit board is disposed in the timing controller and connected to a power supply via a power wire.

In certain classes of this embodiment, the electronic circuit board comprises a microprocessor, an electronic switching circuit, a fault detection circuit, and a low-voltage detection circuit.

In certain classes of this embodiment, the electronic switching circuit comprises multiple triodes.

In certain classes of this embodiment, the fault detection circuit comprises a pair of resistors.

In certain classes of this embodiment, the low-voltage detection circuit comprises a single chip, a pair of resistors, a diode, a triode, and an indicator light.

In certain classes of this embodiment, a lampshade is disposed on the upper shell.

In certain classes of this embodiment, a stop ring, a first gasket, an annular ring, and a second gasket are disposed on the plug bar.

In certain classes of this embodiment, the electromagnetic valve is disposed in the valve body and fixedly connected to the valve body via a connecting sleeve.

In certain classes of this embodiment, a reset spring is disposed below the contact plate.

In certain classes of this embodiment, a connecting plate is disposed on the valve, and the timing controller is fixed to the connecting plate via a first self-tapping screw.

Advantages of the invention include:

1) integration of a timing controller and a control valve;
2) timing control can be implemented mechanically or electrically;
3) compact structure and good appearance;
4) easy operation;
5) safe and reliable; and
6) accurate timing.

BRIEF DESCRIPTION OF THE DRAWINGS

Detailed description will be given below with reference to accompanying drawings, in which.

DETAILED DESCRIPTION OF THE EMBODIMENTS

Figure 1:
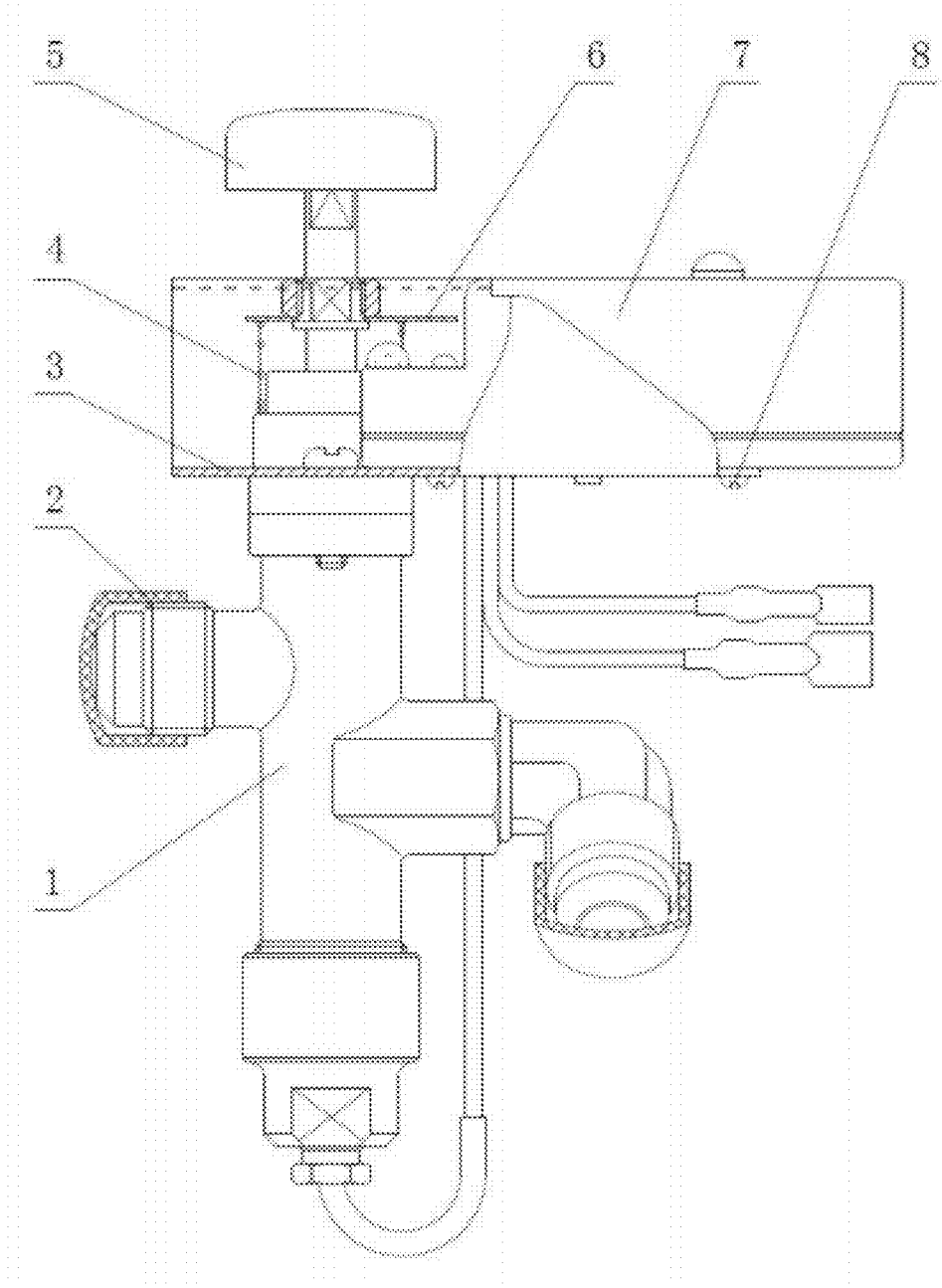
FIG. 1 is a schematic view of a gas valve control device of an exemplary embodiment of the invention.
Figure 2:
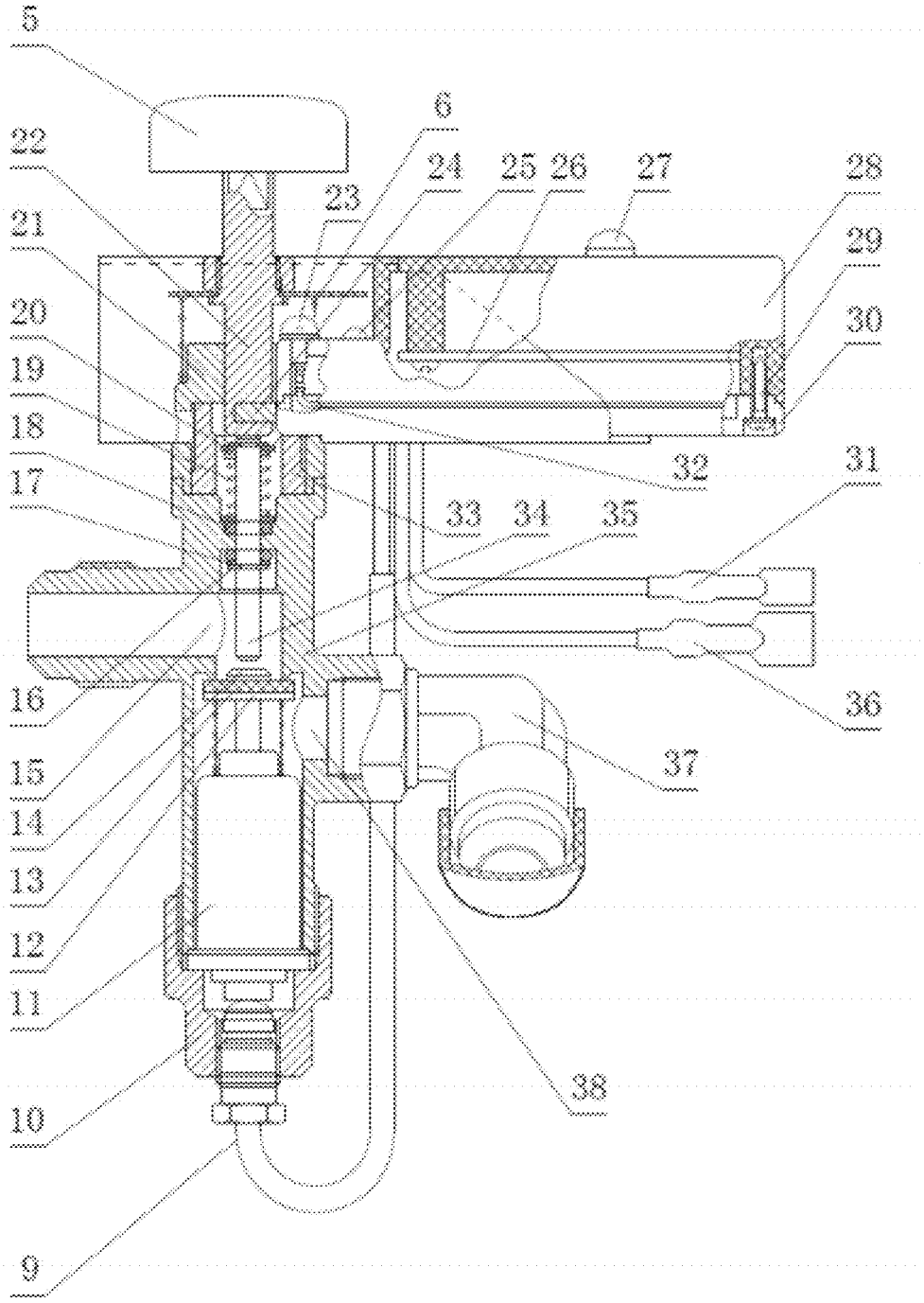
FIG. 2 is a cross-sectional view of the gas valve control device shown in FIG. 1.

As shown in FIGS. 1-2, a gas valve control device comprises a valve 1 and a timing controller 7.

The valve 1 comprises a reset spring 4, a rotating button 5, a contact plate 6, an electromagnetic valve 11, an outlet port 15, an stop ring 16, a gasket 17, an annular ring 18, a gasket 20, a pressing spring 19, a valve cover 21, a fixing pin 24, an inlet port 38, a valve pole 22, a plug bar 34, and a valve body 35 having a cavity.

A vent line is disposed between the inlet port 38 and the outlet port 15, and the vent line is controlled by the timing controller 7.

An upper portion of the valve body 35 is connected to the valve pole 22.

An upper portion of the valve pole 22 protrudes from the valve body 35, and a lower portion thereof is received in the cavity of the valve body 35, whereby enabling the valve pole 22 to move upwards and downwards therein.

The plug bar 34 and the pressing spring 19 are disposed at the bottom of the valve pole 22. The pressing spring 19 is disposed outside the plug bar 34.

The rotating button 5 is disposed at the top of the valve pole 22.

The contact plate 6 is disposed below the rotating button 5 and is connected to the top of the valve pole 22.

The fixing pin 24 is disposed on the valve pole 22, and the valve pole 22 is capable of sliding in a groove in the valve cover 21 via the fixing pin 24.

The rotating button 5 is adapted for being rotated left and right and for moving upwards and downwards in the groove in the valve cover 21. The rotating angle of the rotating button 5 is 120 degrees.

Figure 7:
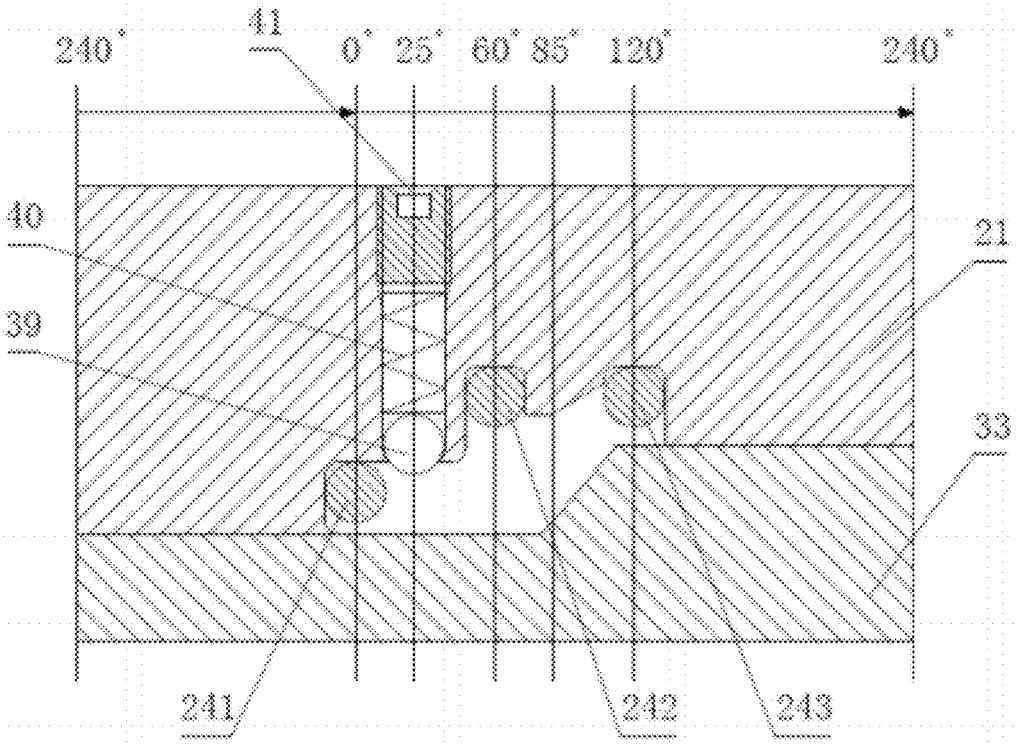
FIG. 7 is an unfolded cross-sectional view of a valve cover and a positioning ring according to an exemplary embodiment of the invention.

The steel ball 39 and the spring 40 are disposed on the valve cover 21 via multiple bolts 41. The steel ball 39 from an upper edge of the groove (as shown in FIG. 7).

A stop ring 16, a first gasket 17, an annular ring 18, and a second gasket 20 are disposed on the plug bar 34.

A reset spring 4 is disposed below the contact plate 6.

As shown in FIG. 2, the timing controller is fixedly connected to the valve 1 and to the electromagnetic valve 11.

The electromagnetic valve 11 is disposed in the valve body 35 and is connected to the valve body 35 via a connecting sleeve 10.

An electromagnetic valve lead 9 is disposed on one end of the electromagnetic valve 11, and the electromagnetic valve 11 is connected to the timing controller 7 via the electromagnetic valve lead 9.

A valve sheet 12 is disposed on the other end of the electromagnetic valve 11 and operates to control the vent line between the inlet port 38 and the outlet port 15, and a sealing gasket 13 and an ejecting block 14 are disposed on the valve sheet 12.

An inlet port joint 37 is connected to the inlet port 38, and a sleeve ring 2 is connected to the outlet port 15.

A connecting plate 3 is disposed on the valve 1, and the timing controller 7 is fixed to the connecting plate 3 via a first self-tapping screw 8.

The timing controller 7 comprises an electronic circuit board 26, an upper shell 28, and a lower shell 30. The electronic circuit board 26 is disposed in the timing controller 7 and connected to a power supply via a power wire.

A lampshade 27, a first contact head 23, a second contact head 251, and a third contact head 252 are disposed at the upper shell 28. The first contact head 23, the second contact head 251, and the third contact head 252 are disposed on the upper shell 28 and are connected to the electronic circuit board 26 via a contact head wire 32.

The electronic circuit board 26 comprises a microprocessor, an electronic switching circuit, a fault detection circuit, and a low-voltage detection circuit.

The electronic switching circuit comprises triodes Q1, Q2, Q3, and Q4.

The fault detection circuit comprises a pair of resistors R13 and R15.

The low-voltage detection circuit comprises a single chip IC2, a pair of resistors R19 and R20, a diode D2, a triode Q5, and an indicator light LED2.

In this embodiment, the microprocessor is a PIC 16F630 single chip, and the single chip IC2 uses an IMP809R chip.

The fault detection circuit operates to protect the timing controller 7 in operation. If electronic components in the electronic circuit board 26 fail, the microprocessor sends a power off signal to disconnect the electronic switching circuit and to release the electromagnetic valve 11. At this time the gas valve control device of the invention is closed whereby preventing accidents caused by a timing error.

The low-voltage detection circuit operates to detect the voltage of the timing controller 7 in operation. If the voltage detected is below 2.63 V, the indicator light LED2 lights up whereby reminding the user of changing a battery and guaranteeing normal operation of the circuit.

The electromagnetic valve 11 is a micro-current electromagnetic valve and features low power consumption, micro-current, low-voltage, and good sealing effect.

Operation of the gas valve control device of the invention is as follow:

The gas valve control device of the invention is installed between a pressure regulating valve and a gas stove, and a negative outside wire and a positive outside wire of the gas valve control device are connected to a battery box. At this time the electric circuit is in a standby state. As the pressure regulating valve is opened, gas enters the inlet port 38 via the inlet port joint 37.

The electromagnetic valve 11 is a non-self-absorption valve, and can only be opened by the valve pole 22 applying pressure thereon while voltage is applied to the electromagnetic valve 11. If no pressure is applied, the electromagnetic valve 11 is closed whereby connecting the air circuit.

The gas valve control device is changed from a non-timing and open state to a timing and open state when the rotating button 5 clockwise rotates from a 0 degree position to a 60 degree position. It should be noted that the air circuit must not be disconnected during rotation, this is implemented by applying pressure on the electromagnetic valve 11 by the valve pole 22 after the electromagnetic valve 11 is powered. Due to manufacturing errors of the valve pole 22, the plug bar 34 and the valve body 35, a holding position of the electromagnetic valve 11 may be affected. To solve this problem, an axial compensation structure formed by the spring 40 and the steel ball 39 on the valve cover 21 effectively ensures that the air circuit is not disconnected during rotation.

Figure 3:
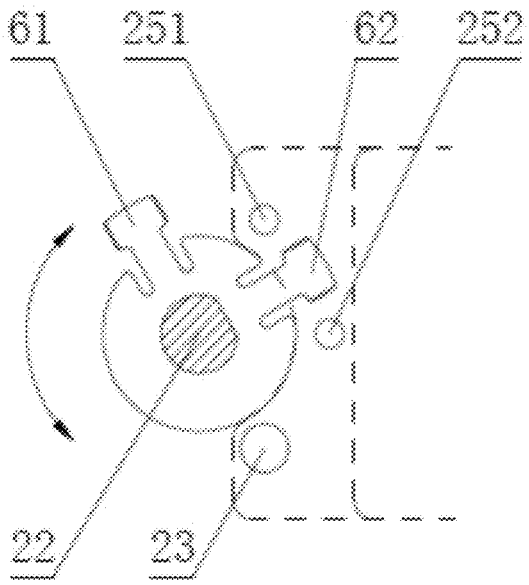
FIG. 3 illustrates a contact plate and contact heads when the rotating button is in a 0 degree position.
Figure 4:
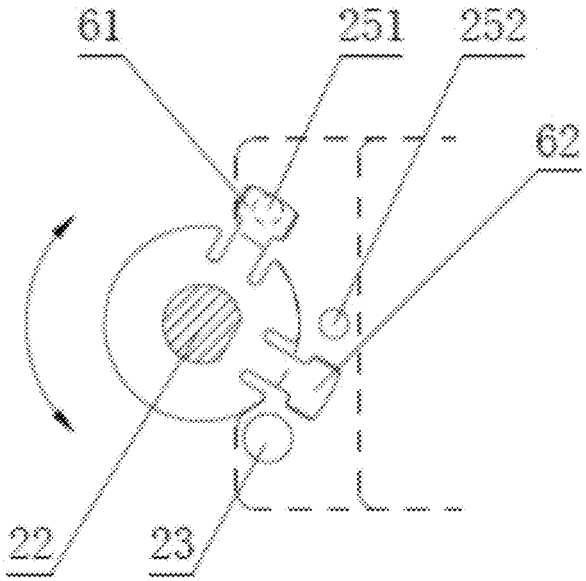
FIG. 4 illustrates a contact plate and contact heads when a rotating button is in a 60 degree position.
Figure 9:
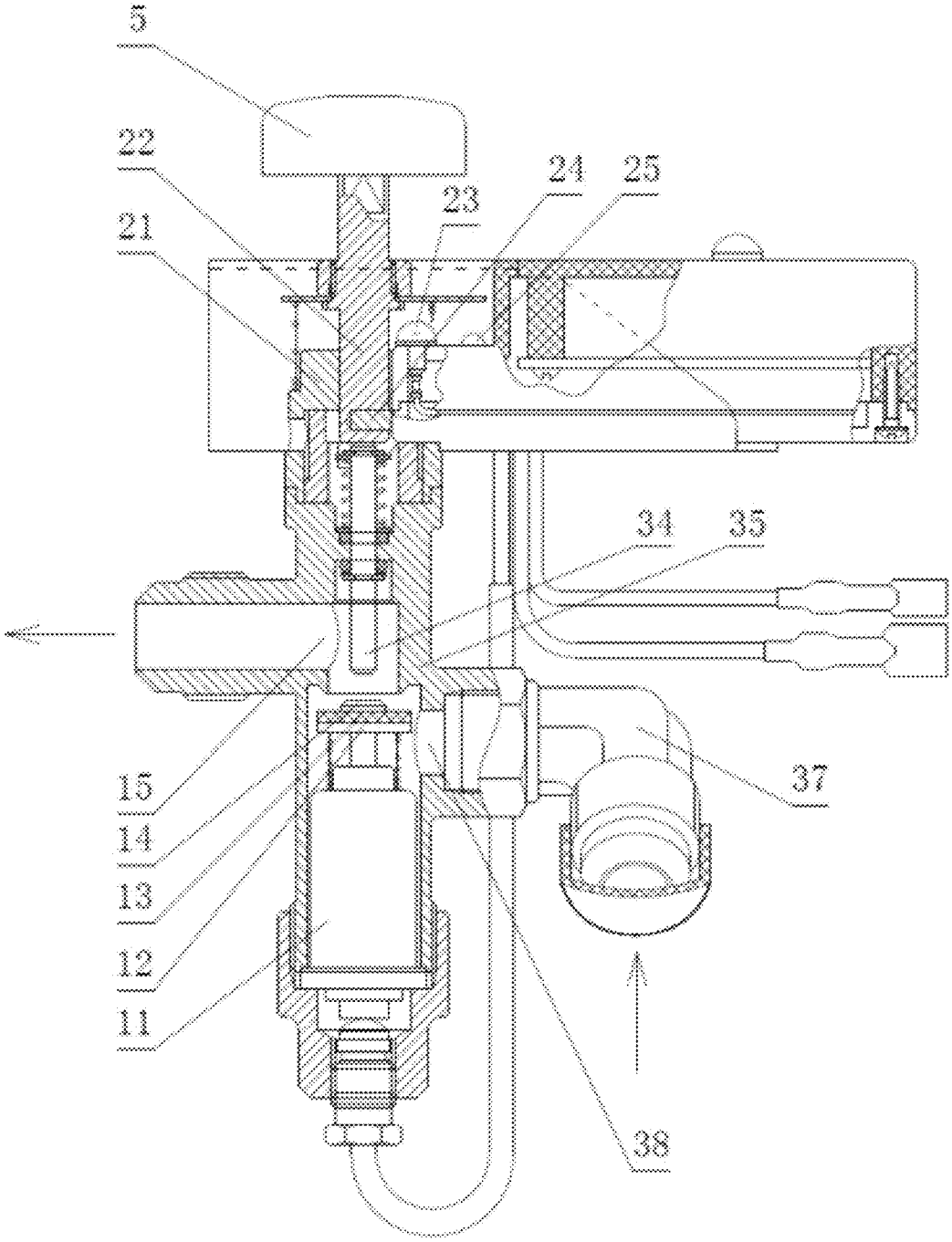
FIG. 9 is a cross-sectional view of a gas valve control device when the vent line is connected.
Figure 10:
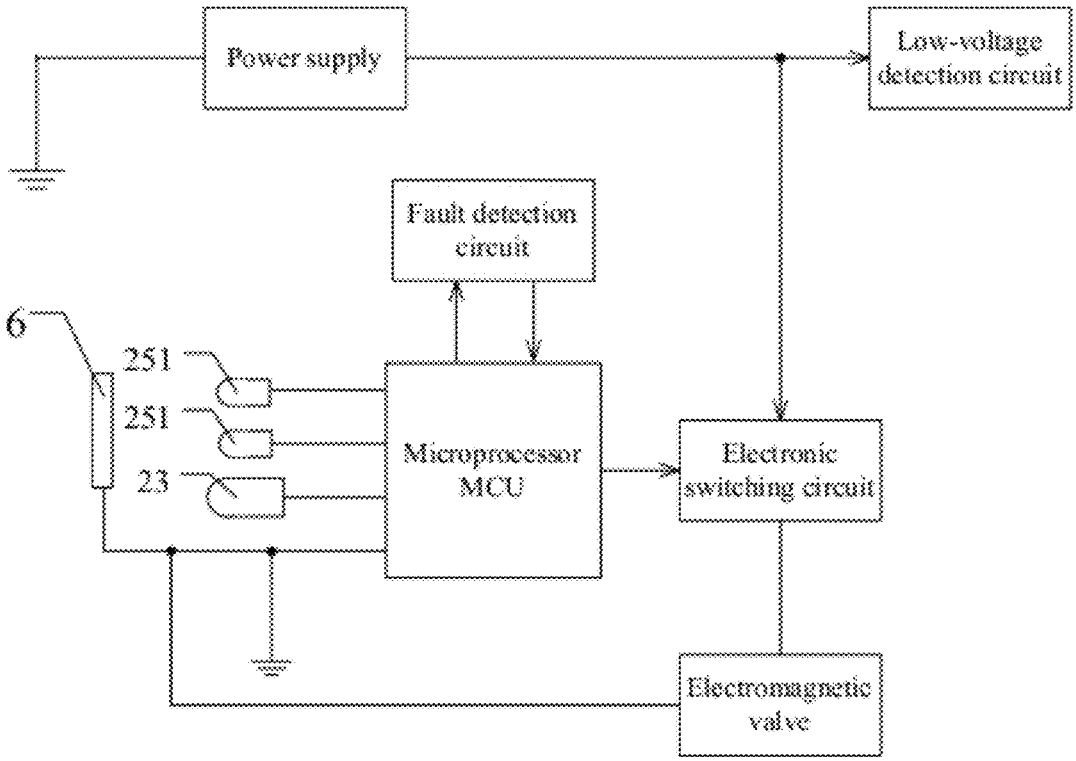
FIG. 10 is a block diagram of a gas valve control device of an exemplary embodiment of the invention.
Figure 11:
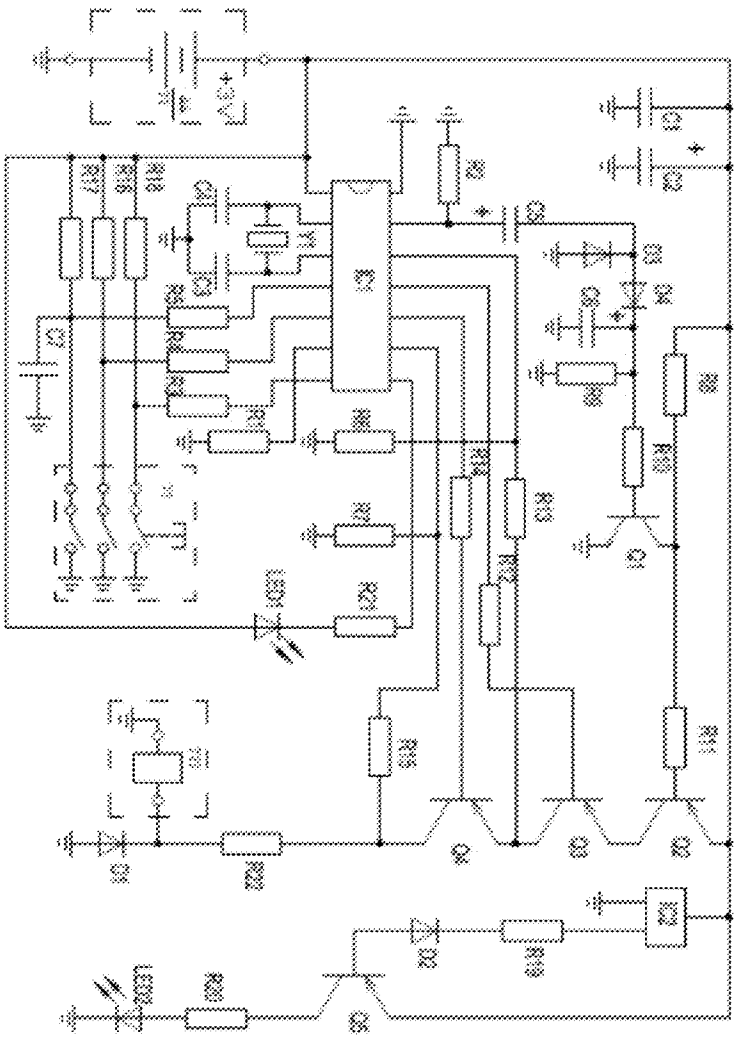
FIG. 11 is a schematic diagram of a gas valve control device of an exemplary embodiment of the invention.

The complete process is as follows:

1) When the rotating button 5 rotates anticlockwise to a 0 degree position, the fixing pin 24 disposed on the valve pole 22 is located at a 0 degree position of the groove (as shown in FIG. 7), the contact plate 6 is located at a 0 degree position (as shown in FIG. 3), and the rotating button 5 and the valve pole 22 are pushed down (as shown in FIG. 7). In this way, the valve pole 22 pushes the plug bar 34 and the ejecting block 14 disposed on the electromagnetic valve 11 and thus the valve is opened, the air circuit is connected, and the gas valve control device is in a non-timing and open state (as shown in FIG. 9). As the rotating button 5 rotates anticlockwise, the contact plate 6 is contacted with the third contact head 252 (the sequence is: disconnect-instant contact-disconnect, as shown in FIG. 4). After a two-second delay, the microprocessor sends a power off signal to disconnect the electronic switching circuit, at this time the indicator light LED1 is off, the electromagnetic valve lead 9 connected to the electromagnetic valve 11 has no output voltage and the timing control circuit is in a hibernating state.

Figure 5:
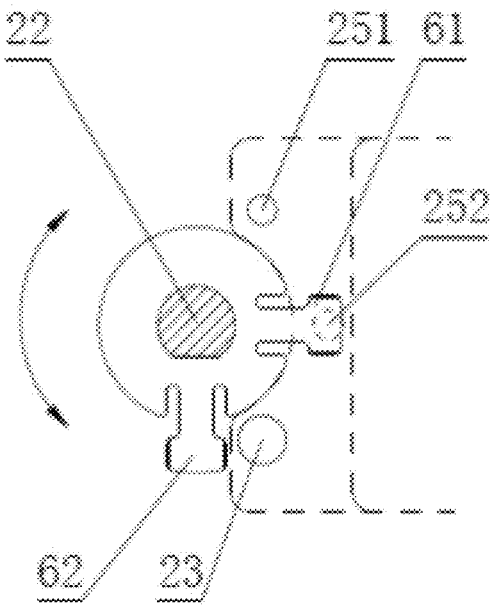
FIG. 5 illustrates a contact plate and contact heads when a rotating button is in a 120 degree position.
Figure 6:
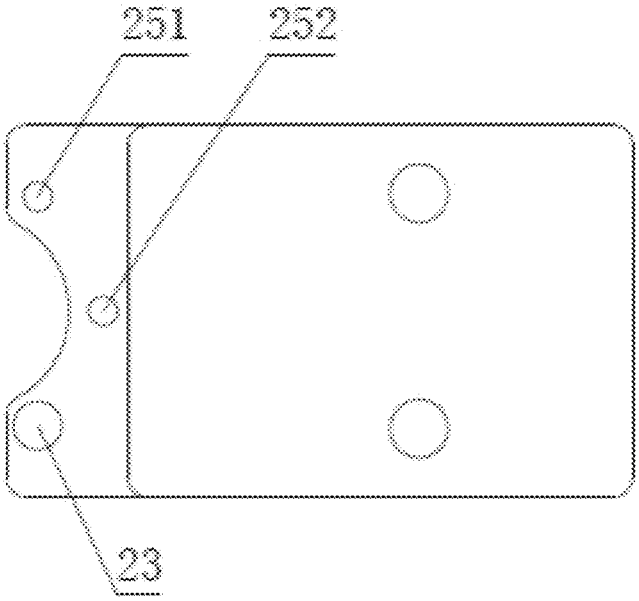
FIG. 6 is a schematic view of multiple contact heads of an exemplary embodiment of the invention.
Figure 8:
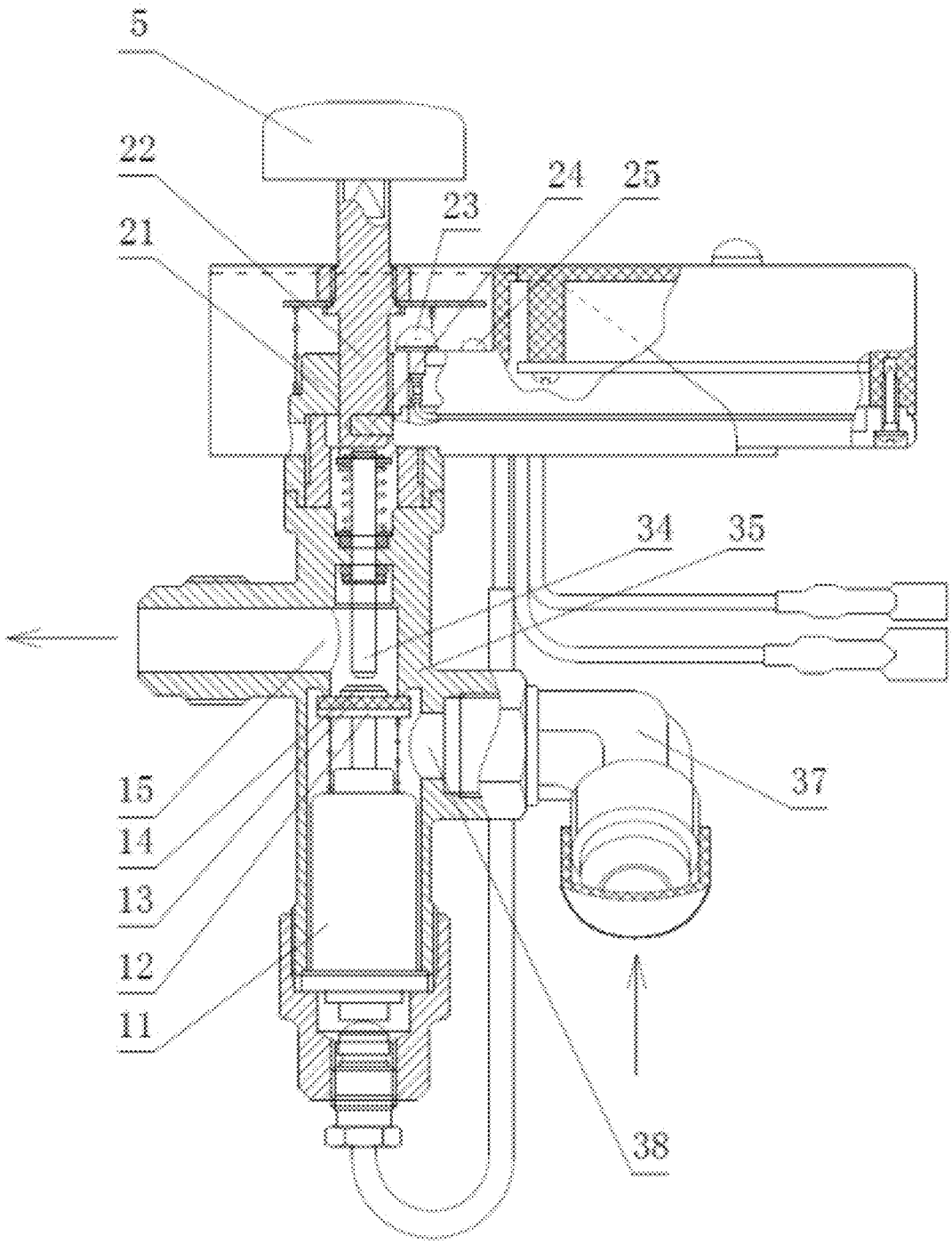
FIG. 8 is a cross-sectional view of a gas valve control device with the vent line disconnected.

2) When the rotating button 5 is rotates clockwise to a 120 degree position, the fixing pin 24 disposed on the valve pole 22 is located at a 120 degree position of the groove (as shown in FIG. 7), the contact plate 6 is located at a 120 degree position (as shown in FIG. 5), and the rotating button 5 and the valve pole 22 are pushed up (as shown in FIG. 7). During rotation, the contact plate 6 is contacted with the first contact head 23 (the sequence is disconnected-instant contact-disconnected, as shown in FIG. 5), at this time the microprocessor sends a power off signal to disconnect the electronic switching circuit, the indicator light LED1 is off, the electromagnetic valve lead 9 connected to the electromagnetic valve 11 has no output voltage, the electromagnetic valve 11 is released, the sealing gasket 13 is lifted up by a spring force, the vent line and the air circuit are disconnected, the gas valve control device is closed. As shown in FIG. 8, the timing control circuit is in a hibernating state.

3) When the rotating button 5 rotates clockwise to a 60 degree position from a 0 degree position, the fixing pin 24 disposed on the valve pole 22 is located at a 60 degree position of the groove (as shown in FIG. 7), the contact plate 6 is located at a 60 degree position (as shown in FIG. 4), and the rotating button 5 and the valve pole 22 are capable of moving upwards and downwards freely (as shown in FIG. 7). During rotation, the air circuit must not be disconnected, and the contact plate 6 is instantly contacted with a prestart/delay third contact head 252, at this time the microprocessor sends a power on signal to connect the electronic switching circuit, and the electromagnetic valve 11 is closed. Then the fixing pin 24 is contacted with the steel ball 39 (as shown in FIG. 7), and pressure is applied to the fixing pin 24 and the valve pole 22 via the compensation structure formed by the spring 40 and the steel ball 39, whereby ensuring the electromagnetic valve 11 is reliably closed. Then, the contact plate 6 is contacted with the second contact head 251 (the sequence is disconnected-instant contact-the valve pole 22 moves upwards-disconnected, as shown in FIG. 4), at this time the microprocessor sends a power on signal, the indicator light LED1 lights up, the electromagnetic valve lead 9 outputs operating voltage to the electromagnetic valve 11, the electromagnetic valve 11 is still closed, the vent line is connected, and the gas valve control device is in an operating state, as shown in FIG. 9.

When a preset timing is up, the microprocessor sends a power off signal, the electronic switching circuit is disconnected, the indicator light LED1 is off, the circuit returns to a standby state, the electromagnetic valve lead 9 has no output voltage, the electromagnetic valve 11 is released, the sealing gasket 13 is lifted up by a spring force, the vent line and the air circuit are disconnected, and the gas valve control device is closed, as shown in FIG. 8.

4) When the rotating button 5 rotates anticlockwise to a 60 degree position from a 120 degree position, the fixing pin 24 disposed on the valve pole 22 is located at a 60 degree position of the groove (as shown in FIG. 7), the contact plate 6 is located at a 60 degree position (as shown in FIG. 5), and the rotating button 5 and the valve pole 22 are capable of moving upwards and downwards freely (as shown in FIG. 7). During rotation, the contact plate 6 is contacted with the first contact head 23 (the sequence is: disconnected-instant contact-disconnected, as shown in FIG. 4). Since the timing control circuit is in a hibernating state, it does not response to the contact process. If the rotating button 5 is not pressed, the gas valve control device is still closed. If the rotating button 5 is pressed, the contact plate 6 is contacted with the second contact head 251, the valve pole 22 drives the plug bar 34 to contact with the ejecting block 14 on the electromagnetic valve 11, so that the contact plate 6, the valve pole 22 and the plug bar 34 are sequentially connected. At this time the microprocessor sends a power on signal, the electronic switching circuit is connected, the indicator light LED1 lights up, the electromagnetic valve lead 9 outputs operating voltage to the electromagnetic valve 11, the electromagnetic valve 11 is still closed, the vent line is connected, and the gas valve control device is in an operating state, as shown in FIG. 9.

When a preset timing is up, the microprocessor sends a power off signal, the electronic switching circuit is disconnected, the indicator light LED1 is off, the circuit returns to a standby state, the electromagnetic valve lead 9 has no output voltage, the electromagnetic valve 11 is released, the sealing gasket 13 is lifted up by a spring force, the vent line is disconnected, and the gas valve control device is closed, as shown in FIG. 8.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A gas valve control device, comprising a timing controller (7); and a valve (1), comprising:

a rotating button (5);

a contact plate (6);

an electromagnetic valve (11);

a pressing spring (19);

a valve cover (21);

a valve pole (22);

a fixing pin (24);

a plug bar (34); and a valve body (35) having a cavity;

wherein:

an upper portion of said valve body (35) is connected to said valve pole (22);

an upper portion of said valve pole (22) protrudes from said valve body (35);

a lower portion of said valve pole (22) is received in said cavity of said valve body (35) whereby enabling said valve pole (22) to move upwards and downwards therein;

said plug bar (34) and said pressing spring (19) are disposed at the bottom of said valve pole (22);

said pressing spring (19) is disposed outside said plug bar (34);

said rotating button (5) is disposed at the top of said valve pole (22);

said contact plate (6) is disposed below said rotating button (5) and connected to the top of said valve pole (22);

said fixing pin (24) is disposed on said valve pole (22);

said valve pole (22) is adapted for sliding in a groove in said valve cover (21) via said fixing pin (24);

said rotating button (5) is adapted for rotating left and right and moving upwards and downwards in said groove; and said timing controller (7) is fixedly connected to said valve (1).

2. The gas valve control device of claim 1, wherein said valve body (35) comprises an inlet port (38), an outlet port (15) and a vent line;

said inlet port (38) and said outlet port (15) are disposed on said valve body (35);

said vent line is disposed between said inlet port (38) and said outlet port (15); and said vent line is controlled by said timing controller (7).

3. The gas valve control device of claim 2, wherein an inlet port joint (37) is connected to said inlet port (38); and a sleeve ring (2) is connected to said outlet port (15).

4. The gas valve control device of claim 2, wherein an electromagnetic valve lead (9) is disposed on one end of said electromagnetic valve (11);

said electromagnetic valve (11) is connected to said timing controller (7) via said electromagnetic valve lead (9);

a valve sheet (12) is disposed on the other end of said electromagnetic valve (11) and operates to control said vent line; and a sealing gasket (13) and an ejecting block (14) are disposed on said valve sheet (12).

5. The gas valve control device of claim 1, wherein said timing controller (7) comprises an electronic circuit board (26), an upper shell (28), and a lower shell (30);

a first contact head (23), a second contact head (251), and a third contact head (252) are disposed on said upper shell (28) and connected to said electronic circuit board (26) via a contact head wire (32); and said electronic circuit board (26) is disposed in said timing controller (7) and connected to a power supply via a power wire.

6. The gas valve control device of claim 5, wherein said electronic circuit board (26) comprises a microprocessor, an electronic switching circuit, a fault detection circuit, and a low-voltage detection circuit.

7. The gas valve control device of claim 6, wherein said electronic switching circuit comprises multiple triodes.

8. The gas valve control device of claim 6, wherein said fault detection circuit comprises a pair of resistors.

9. The gas valve control device of claim 6, wherein, said low-voltage detection circuit comprises a single chip, a pair of resistors, a diode, a triode, and an indicator light.

10. The gas valve control device of claim 5, wherein a lampshade (27) is disposed on said upper shell (28).

11. The gas valve control device of claim 1, wherein a stop ring (16), a first gasket (17), an annular ring (18), and a second gasket (20) are disposed on said plug bar (34).

12. The gas valve control device of claim 1, wherein said electromagnetic valve (11) is disposed in said valve body (35) and fixedly connected to said valve body (35) via a connecting sleeve (10).

13. The gas valve control device of claim 1, wherein a connecting plate (3) is disposed on said valve (1); and said timing controller (7) is fixed to said connecting plate (3) via a first self-tapping screw (8).

* * * * *